US005269604A

United States Patent [19]

Ewers

[11] Patent Number: 5,269,604

[45] Date of Patent: Dec. 14, 1993

[54] SLURRY HAULING VEHICLE

[76] Inventor: R. Otto Ewers, 11029 Stonewall, Corpus Christi, Tex. 78410

[21] Appl. No.: 43,531

[22] Filed: Apr. 6, 1993

[51] Int. Cl.[5] ..... B01F 7/08

[52] U.S. Cl. ..... 366/277; 366/331; 441/518; 441/526

[58] Field of Search ..... 366/276, 277, 279, 289, 366/331, 332, 64, 65, 186, 194, 195, 196, 321, 603; 414/518, 526

[56] References Cited

U.S. PATENT DOCUMENTS

| | | | |
|---|---|---|---|
| 2,522,077 | 9/1950 | Wahl et al. | 414/502 |
| 3,424,438 | 1/1969 | Knotts | 366/162 |
| 4,407,622 | 10/1983 | Ito | 414/468 |
| 4,599,004 | 7/1986 | Keith | 366/64 |
| 5,147,133 | 9/1992 | White | 366/138 |

*Primary Examiner*—Robert W. Jenkins
*Attorney, Agent, or Firm*—G. Turner Moller

[57] ABSTRACT

A trailer provides a slurry hauling tank having an auger mounted for swinging movement inside the tank. A rotary hydraulic motor inside the tank drives the auger and is powered by fluid delivered through a rotary fitting extending through the tank wall. Relatively stiff stainless steel conduit connects the rotary fitting to the auger motor. The auger is oscillated through an arc while the trailer is being loaded, towed toward a disposal site and during unloading by a hydraulic motor on the outside of the tank. A hydraulic circuit alternately drives the motor in one direction and then in another direction. In one embodiment, the hydraulic circuit reverses by use of a pressure responsive cycling valve. In another embodiment, microswitches are used to reverse the hydraulic motor.

16 Claims, 4 Drawing Sheets

SLURRY HAULING VEHICLE

This invention relates to a slurry hauling vehicle such as a trailer or truck.

Vacuum trucks have been widely used to haul a variety of liquids and slurries for many years. In its simplest design, a vacuum truck is a large generally cylindrical tank mounted on a trailer or truck body and a vacuum pump or fan manifolded to remove air from the tank for filling the tank or to deliver air to the tank for emptying the tank. There is generally no difficulty loading and unloading liquids.

Loading and unloading slurries present somewhat different problems. So long as the liquid phase of the slurry is relatively large and the solid phase relatively small, slurries act much like liquids and present no substantial problem. As the solid phase becomes relatively larger, it becomes more difficult to load, and particularly to unload, slurries from a conventional general purpose vacuum truck. A variety of factors act to create these difficulties but the end result is that solid particles come out of suspension, settle to the bottom of the cylindrical tank and do not flow to the outlet when it is opened. Special purpose trucks or trailers designed to haul more-or-less hazardous material from a generation site to a disposal site have evolved to eliminate the vacuum pump or fan because these vehicles are loaded by special purpose equipment, such as hoppers, hoses or the like, rather than by withdrawing air from the tank.

In response to the problem of unloading slurries from tank type vehicles, agitating mechanisms have been installed in the tanks to resuspend the slurries when the vehicle arrives at the discharge site. Initially, these mechanisms included an auger extending along the bottom of the tank, parallel to the cylindrical axis. These augers rotate about their axis but were mounted in fixed bearings at opposite ends of the tank. Disclosures of this type are found in U.S. Pat. Nos. 2,522,077; 3,259,261; 3,424,438; 4,407,622 and 5,147,133. Other disclosures of interest are found in U.S. Pat. Nos. 510,545; 539,288; 2,320,469; 2,447,202; 2,478,079; 3,187,910; 3,259,261; 3,273,863; 3,511,399; 4,140,349; 4,289,428 and 4,444,277.

At least one design was proposed to haul cuttings from bore holes drilled into the earth with an oil base mud. This trailer incorporated an auger mounted for swinging movement about an axis more-or-less coincident with the cylindrical tank axis. In this device, the vehicle traveled to the discharge site with the auger in its lowermost position. At the discharge site, a power take off arrangement was used to drive a first hydraulic motor to rotate the auger about its axis and a second hydraulic motor to swing the auger through an arc on both sides of the lowermost position thereby resuspending the solids in the liquid phase. After the solids were resuspended, the outlet was opened and the slurry discharged. It is not known whether this device is prior art but it will suffice to say that applicant is not the inventor thereof. It is this type device with which this invention most nearly relates.

Complete unloading of a hazardous slurry is very important for a variety of reasons. From a practical standpoint, no one wants to haul a tank having a sizeable percentage of a previous hazardous load still in the tank. From a regulatory standpoint, if a tank contains more than about 0.3% of a previous hazardous load, the tank is required to have a manifest and be treated thereafter as if the load is hazardous. Washing or rinsing the tank at the disposal site is not desirable because the rinse water has to be treated as hazardous and disposed of properly. Sending an individual into the tank to clean it is not desirable for obvious reasons. The preferred solution to these difficulties is to produce a tank which is capable of readily unloading a hazardous slurry, even one that is mostly solids and little liquid, so that very little of the hazardous material remains in the tank. Besides the obvious advantages, there is a subtle and cumulative advantage of unloading substantially all of the hazardous material rather than haul a sizeable portion of it back to the generation site—the empty vehicle has a larger capacity than one that still contains some of the previous load.

In this invention, means are provided to continuously oscillate the auger in the tank as the vehicle is moving to the discharge site as opposed to stopping the auger during travel and then resuspending the solids after reaching the discharge site. It might be thought that swinging the auger during normal travel is dangerous because it changes the center of gravity of the vehicle and might make the vehicle unstable. This has not proven to be the case because the auger moves fairly slowly and the auger is light compared to the loaded weight of the vehicle.

In contrast to the prior art where the solids fall out of suspension and pack around the auger, in this invention the solids remain suspended in the slurry. Thus, a substantial problem in the prior art is avoided because the solids do not become so packed around the auger that it cannot be rotatably driven or swung when it is time to unload. Continuously oscillating the auger may be done in a variety of ways, the most elegant of which is to incorporate a reversing valve that reverses movement of the hydraulic motor swinging the auger in response to a pressure buildup in the system as occurs when the auger reaches one limit of its travel. One advantage of such a system is that the auger swings back and forth even if there is some obstruction in the tank blocking normal design swinging movement of the auger.

Another difficulty with swinging or oscillating the auger in the tank is providing high pressure fluid to drive a motor rotating the auger. The simplest technique is to provide a fitting extending through the tank wall at a location spaced from the axis of rotation and use long flexible hoses inside the tank connecting the fitting to the motor. This approach is undesirable, particularly when hauling slurries containing corrosive or hazardous materials. Sooner or later, the long flexible hoses break or leak due to corrosion from the corrosive materials which, when the leaking hose connects to the pump inlet, draws the slurry into the pump thereby disabling the pump and exposing the pump to the corrosive or hazardous material.

In accordance with one aspect of this invention, the high pressure power fluid is delivered to the agitator motor through a rotatable connection extending across the tank wall on the axis of rotation so the connection swings with the agitator motor. Short, relatively stiff non-corrodable conduit, usually stainless steel, delivers high pressure power fluid from the connection to the agitator motor. This conduit may be rigid tubing if it is protected from the inertia of the slurry, as by placing the tubing inside a box channel or other stronger conduit. In the alternative, the conduit may be of the stainless steel braided type having a Teflon inner sleeve. Such conduit is relatively immune from corrosion so pump failure from ingesting corrosive or hazardous slurry is substantially eliminated.

In one aspect, this invention comprises a vehicle for hauling slurries along a roadway including a wheeled frame having thereon a tank including an inlet and an outlet, means for agitating materials in the tank including an agitator having an axis, a motor for rotating the agitator about its axis and means mounting the agitator for moving the agitator axis in a predetermined path in the tank, and means for oscillating the agitator mounting means when the vehicle is moving along the roadway.

In another aspect, this invention comprises a vehicle for hauling slurries along a roadway, including a wheeled frame having thereon a tank including an inlet and an outlet, means for agitating materials in the tank including an agitator in the tank having a first axis and a fluid first motor in the tank for rotating the agitator about the first axis, means swingably mounting the agitator about a second axis including a first bearing member affixed to the tank having a passage therein, a second bearing member received in the first bearing member passage and extending from a location outside the tank to a location inside the tank and means connecting the agitator to the second bearing member for rotation therewith about the second axis, a second motor for swinging the agitator mounting means about the second axis, a fluid pump and conduit means connecting the fluid pump to the first motor including the second bearing member, the connection comprising the second bearing member comprising first and second separate passages therethrough, first and second conduits connecting the first and second passages inside the tank to the first motor, and third and fourth flexible conduits connecting the first and second passages outside the tank to the fluid pump.

It is accordingly an object of this invention to provide an improved vehicle for transporting and unloading slurries.

Another object of this invention is to provide an improved slurry hauling vehicle incorporating a swinging auger for keeping solids suspended in the slurry.

A further object of this invention is to provide an improved slurry hauling vehicle having means to prevent corrosion of power fluid conduits inside the tank.

These and other objects of this invention will become more fully apparent as this description proceeds, reference being made to the accompanying drawings and appended claims.

IN THE DRAWINGS

Figure 1:
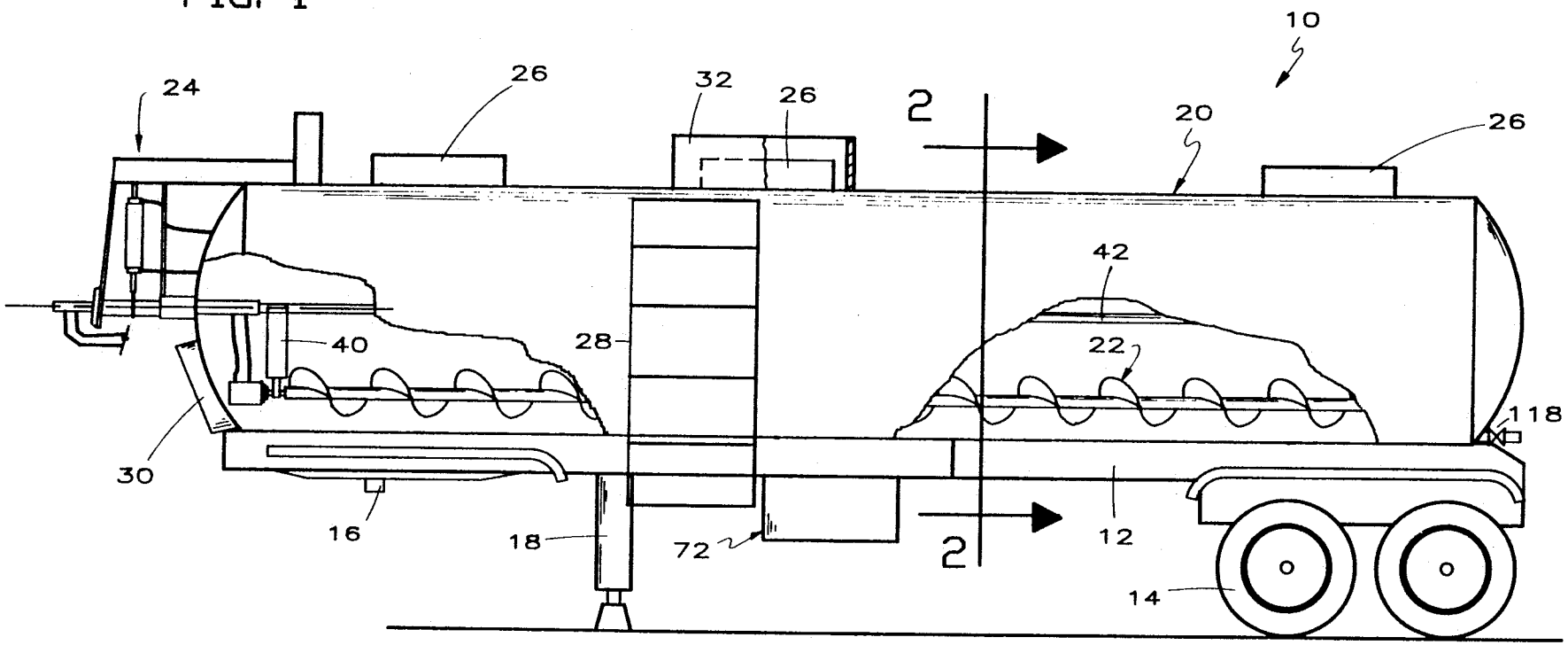
FIG. 1 is a side elevational view of a slurry hauling vehicle of this invention, certain parts being broken away for clarity of illustration.
Figure 4:
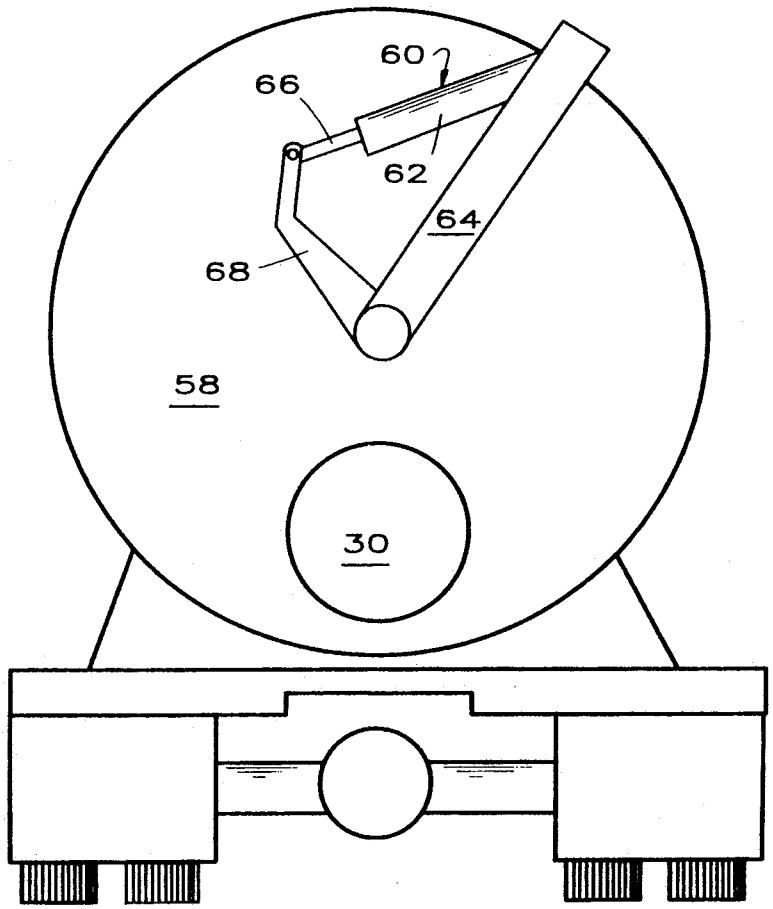
FIG. 4 is a front or end view of the slurry hauling vehicle of this invention.

Referring to FIGS. 1–4, a slurry hauling vehicle 10 of this invention is illustrated of the trailer type including a frame 12, a plurality of wheels 14, a king pin 16 for connection to a towing truck (not shown), a trailer stand 18, a large cylindrical tank 20, an agitator 22 for mixing the contents of the tank 20 and means 24 for moving the agitator 22 inside the tank 20. A vacuum pump or fan (not shown) may be provided on the trailer or on the truck with which the trailer 10 is associated.

The tank 20 includes one or more manways 26 through the top of the tank 20, a ladder 28 providing access to the top of the tank 20 and a manway 30 providing access to the front of the tank 20 for purposes more fully apparent hereinafter. Special purpose slurry hauling vehicles are often loaded through the center manway 26 so an open top overflow box 32 is welded to the tank exterior to provide a compartment for catching overflow or splash.

Figure 2:
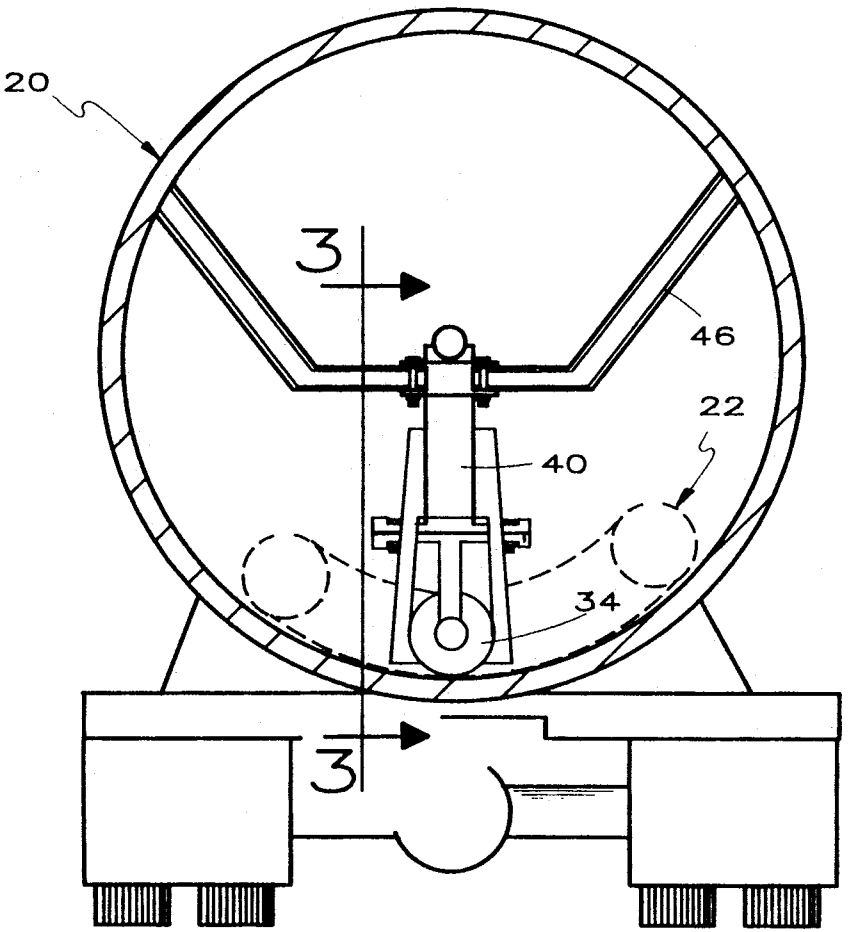
FIG. 2 is an enlarged cross-sectional view of the slurry hauling vehicle of FIG. 1, taken substantially along line 2—2 thereof as viewed in the direction indicated by the arrows.
Figure 3:
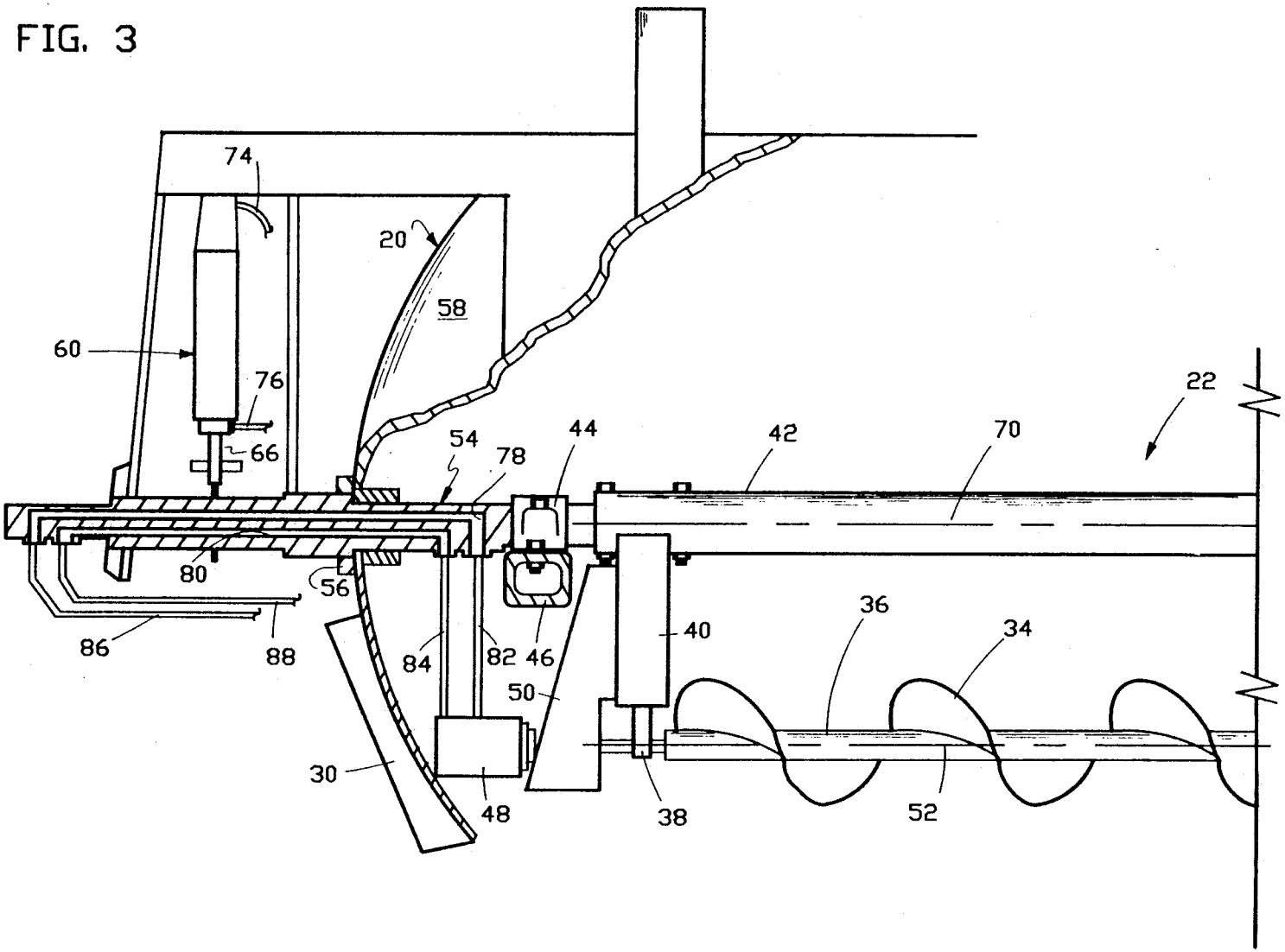
FIG. 3 is an enlarged partial side view of the front end of the vehicle of FIG. 1, certain parts being broken away to illustrate an auger motor and assembly for delivering power fluid thereto.

As shown best in FIG. 2 and 3, the agitator 22 comprises an auger 34 mounted on a shaft 36 rotatable in a plurality of bearings 38 mounted on the ends of struts 40. The struts 40 are mounted on a shaft 42 journalled in a plurality of bearings 44 supported on beams 46 extending across the tank 20. A hydraulic motor 48 is mounted on an extension 50 of the strut 40 and rotates the auger shaft 36 about its axis 52. The auger 34 and motor 48 are thus mounted for swinging movement in the tank through an arc of desired length as shown in FIG. 2. It appears that an arc of about 30° on both sides of vertical is sufficient to keep slurries in suspension although it will be apparent that auger 34 may be swung through an arc of any desired size.

An interesting feature of this invention is that the manway 30 is on the front of the tank 20 rather than on the rear which is customary. Thus, removing the manway cover provides access to the motor 48 for assembly, repair or replacement.

The shaft 42 accordingly includes an end fitting 54 extending through a sealed bearing 56 in the front wall 58 of the tank 20 aligned with the bearings 44. A hydraulic motor 60 includes a cylinder end 62 pivoted to a stationary strut 64 (FIG. 4) and a rod end 66 pivotally connected to a crank arm 68 for oscillating the fitting 54 and the shaft 42 about an axis 70.

The hydraulic motors 48, 60 are powered from an engine-pump assembly 72 mounted under the frame 12 as shown in FIG. 1. The assembly 72 delivers high pressure power fluid through a pair of conduits 74, 76 including flexible conduit sections connected to the motor 60 for driving the motor 60 in opposite directions to producing the swinging movement shown in FIG. 2.

Driving the motor 48 is more complicated because the power fluid path must cross the tank wall. Rather than use flexible conduits inside the tank 20 which are subject to leaking or breaking from corrosion, the fitting 54 provides a pair of axial passages 78, 80 connected to relatively stiff non-corrodable conduits 82, 84 in turn connected to the motor 48. Because the motor 48 remains at a fixed distance from the axis 70, there is no relative movement between the motor 48 and fitting 54 so the conduits 82, 84 may be rigid or relatively stiff. Thus, the conduits 82, 84 are preferably of stainless steel, braided stainless steel or other high pressure, non-corroding material. Because the distance between the motor 48 and the inner end of the fitting 54 is relatively short, the conduits 82, 84 are relatively short.

Early prototypes with rigid stainless steel tubing for the conduits 82, 84 revealed some mechanical distortion of the conduits and of the threaded couplings thereof caused by inertia of the slurry. Thus, the conduits 82, 84 are slightly flexible, such as braided stainless steel, or are protected inside a box channel or conduit (not shown).

The ends of the passages 78, 80 outside the tank 20 are connected by flexible hoses 86, 88 to the engine-pump assembly 72. The flexible hoses 86, 88 accordingly accommodate the relative movement occurring between the fitting 54 and the tank 20. By using rigid non-corrodable conduits 82, 84 in the tank 20, there is little risk of drawing the corrosive or hazardous material from the tank 20 into the engine-pump assembly 72 because the conduits 82, 84 will almost never leak.

Figure 5:
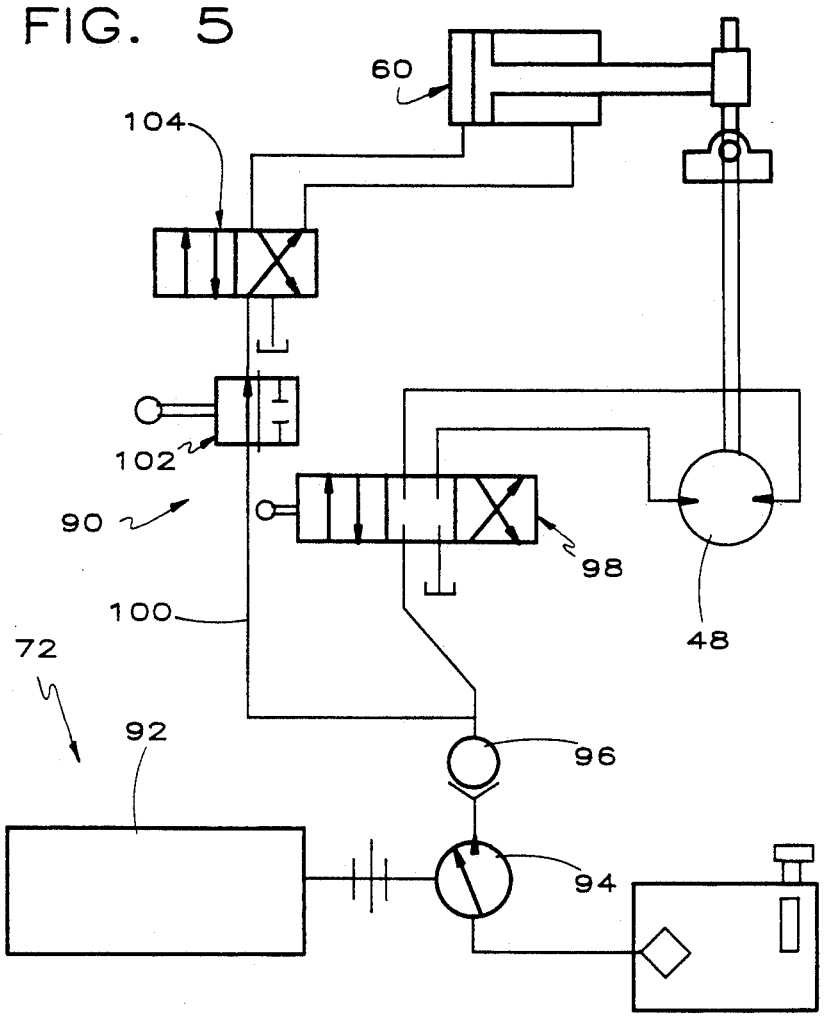
FIG. 5 is a schematic view of one embodiment of a fluid circuit of this invention.

As mentioned previously, it is desirable to automatically swing the auger 34 about the axis 70 in a more-or-less continuous manner, particularly when the vehicle 10 is moving along a road leading to the disposal site. To this end, a hydraulic circuit 90 is provided as shown in FIG. 5. The engine-pump assembly 72 includes an internal combustion engine 92 driving a pump 94. A check valve 96 delivers hydraulic fluid to a manually operable selector valve 98 which provides a first end position driving the motor 48 in a clockwise direction, a second end position driving the motor 48 in a counterclockwise direction and a central position stopping the motor 48.

A branch conduit 100 downstream of the check valve 96 delivers high pressure power fluid to a manual on-off selector valve 102 which connects to a pressure responsive cycling valve 104. The pressure responsive cycling valve 104 senses pressure downstream thereof and reverses position upon sensing a predetermined high pressure. Thus, the cycling valve 104 delivers power fluid to the motor 60 to drive it in one direction until a predetermined high pressure is sensed and then shifts to deliver power fluid to the opposite end of the motor 60 to drive it in the opposite direction. Pressure responsive cycling valves are well known in the art and one suitable valve for use in this invention is available from Wandfluh A.G., Frutigen, Switzerland as model number AQ4Z100/315.

Figure 6:
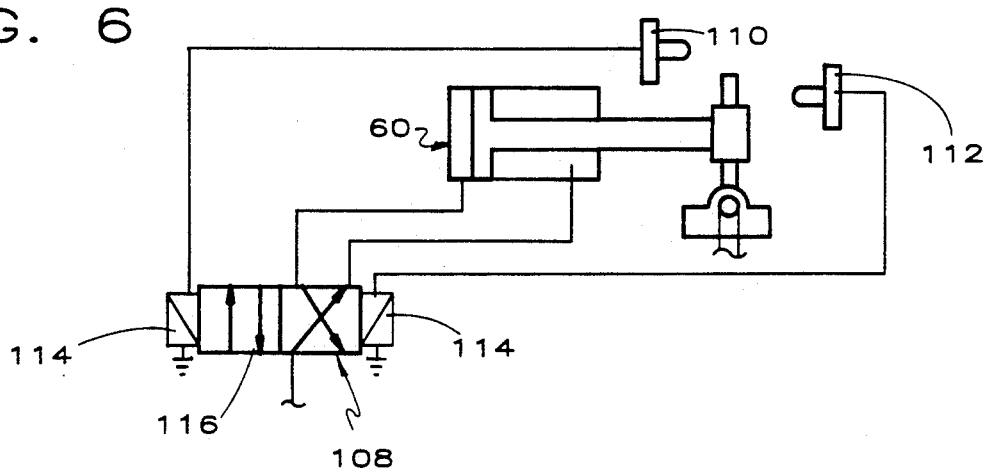
FIG. 6 is a partial schematic view of another embodiment of a fluid circuit of this invention.

Referring to FIG. 6, there is illustrated another embodiment of a hydraulic circuit 106 for oscillating the auger 34 about the axis 70. A solenoid operated reversing valve 108 alternately connects a source of power fluid to the conduits 74, 76. A pair of microswitches 110, 112 connect to a pair of solenoid operators 114 for moving the valve body 116 when either of the microswitches 110, 112 is closed by contact with some moving component of the motor 60 or the crank arm 68.

Operation of the vehicle 10 of this invention should now be apparent. The tank 20 may be loaded in any suitable fashion, as with a hose or hopper dumping into the central manway 26. The engine-pump assembly 72 may be started at any time, either before, during or after loading, to drive the motors 48, 60 to rotate the auger 34 and to swing it about the axis 70. Desirably, the motors 48, 60 are driven during loading of the tank 20 and during travel of the vehicle 10 toward the disposal site. When the vehicle 10 arrives at the disposal site, it is unloaded through a valved outlet conduit 118 on the rear of the tank 20 as shown in FIG. 1.

By driving and swinging the auger 34 during travel of the vehicle 10, the solids remain suspended in the slurry and can be easily and quickly unloaded. Results with production versions of this invention have consistently unloaded 99.7%+ of the slurry so the tank 20 does not have to be treated from a regulatory standpoint as containing hazardous material after unloading.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A vehicle for hauling slurries along a roadway, comprising a wheeled frame having thereon a tank including an inlet and an outlet;

means for agitating materials in the tank including an agitator having an axis, a motor for rotating the agitator about its axis and means mounting the agitator for moving the agitator axis in a predetermined path in the tank; and means for continuously moving the agitator mounting means when the vehicle is moving along the roadway.

2. The vehicle of claim 1 wherein the vehicle is a trailer.

3. The vehicle of claim 1 where the agitator is an auger.

4. The vehicle of claim 1 wherein the agitator mounting means comprises means mounting the agitator for movement between first and second limits and the continuously moving means comprises means for oscillating the agitator mounting means between the first and second limits.

5. The vehicle of claim 4 wherein the agitator mounting means comprises means for swingably mounting the agitator and the means for oscillating the agitator mounting means comprises means for swinging the agitator alternately in a clockwise direction and then in a counterclockwise direction.

6. The vehicle of claim 5 wherein the oscillating means comprises a fluid motor, a fluid pump for delivering high pressure fluid to the motor and a pressure responsive reversing valve between the pump and the motor for delivering high pressure fluid to the motor for driving it in the clockwise direction until the pressure of the fluid reaches a predetermined high value and then delivering high pressure fluid to the motor for driving it in the counterclockwise direction.

7. The vehicle of claim 5 wherein the oscillating means comprises a fluid motor, a fluid pump for delivering high pressure fluid to the motor, a reversing valve between the pump and the motor for delivering high pressure fluid to the motor for driving it in the clockwise direction the valve is reversed and then delivering high pressure fluid to the motor for driving it in the counterclockwise direction, and switch means positioned for manipulating the reversing valve at the first and second limits.

8. The vehicle of claim 1 wherein the frame and tank have a front end and a rear end, the agitator motor is located adjacent the front end of the tank and the tank comprises a manway on the front end thereof providing access to the agitator motor.

9. The vehicle of claim 1 wherein the agitator mounting means comprises a first bearing member affixed to the tank having a passage therein, a second bearing member received in the first bearing member passage and extending from a location outside the tank to a location inside the tank, and means connecting the agitator to the second bearing member for rotation therewith about an axis; the agitator motor is a fluid motor and further comprising a fluid pump and conduit means connecting the fluid pump to the agitator motor including the second bearing member, the conduit means comprising the second bearing member comprising first and second separate passages therethrough, first and second conduits connecting the first and second passages inside the tank to the first motor, and third and fourth flexible conduits connecting the first and second passages outside the tank to the fluid pump.

10. A vehicle for hauling slurries along a roadway, comprising a wheeled frame having thereon a tank including an inlet and an outlet;

means for agitating materials in the tank including an agitator in the tank having a first axis and a fluid first motor in the tank for rotating the agitator about the first axis;

means swingably mounting the agitator about a second axis including a first bearing member affixed to the tank having a passage therein, a second bearing member received in the first bearing member passage and extending from a location outside the tank to a location inside the tank and means connecting the agitator to the second bearing member for rotation therewith about the second axis;

a second motor for swinging the agitator mounting means about the second axis;

a fluid pump and conduit means connecting the fluid pump to the first motor including the second bearing member, the conduit means comprising the second bearing member comprising first and second separate passages therethrough, first and second conduits connecting the first and second passages inside the tank to the first motor, and third and fourth conduits connecting the first and second passages outside the tank to the fluid pump.

11. The vehicle of claim 10 wherein the second motor includes means mounting the second motor on the outside of the tank.

12. The vehicle of claim 11 wherein the second bearing member comprises a shaft providing the second axis and the first and second passages are generally parallel to the shaft, the second motor having an output member driving the shaft.

13. The vehicle of claim 10 wherein the third and fourth conduits being more flexible than the first and second conduits.

14. The vehicle of claim 10 wherein the first and second conduits are of a stainless steel material.

15. A method of moving a slurry along a roadway with a vehicle comprising a wheeled frame having thereon a tank including an inlet and an outlet, means for agitating materials in the tank including an agitator having an axis, a motor for rotating the agitator about its axis, means mounting the agitator for moving the agitator axis in a predetermined path in the tank and means for oscillating the agitator mounting means between first and second limit positions, the method comprising the step of moving the agitator mounting means while the vehicle is moving along the roadway.

16. The method of claim 15 wherein the moving step comprises swinging the agitator mounting means on opposite sides of an axis.

* * * * *